United States Patent [19]

Garthwaite et al.

[11] 4,386,840

[45] Jun. 7, 1983

[54] DUAL FLASH FUSER REFLECTOR WITH ALTERNATING FLASH FOR POWER REDUCTION

[75] Inventors: Albert N. Garthwaite, Boulder; Luis A. Suarez, Jr., Longmont, both of Colo.

[73] Assignee: International Business Machines Corporation, Armonk, N.Y.

[21] Appl. No.: 267,131

[22] Filed: May 22, 1981

[51] Int. Cl.[3] ..... G03G 15/20

[52] U.S. Cl. ..... 355/3 FU; 355/14 FU; 355/77; 219/216; 430/124

[58] Field of Search ..... 355/14 FU, 3 FU, 77; 219/216, 388; 432/8, 45, 59; 430/33, 97, 124

[56] References Cited

U.S. PATENT DOCUMENTS

| | | | |
|---|---|---|---|
| 3,445,626 | 5/1969 | Michaels | 219/216 |
| 3,474,223 | 10/1969 | Leiga et al. | 219/216 |
| 3,871,761 | 3/1975 | Mabrouk | 219/216 |
| 4,034,186 | 7/1977 | Bestenrei ner et al. | 219/216 |
| 4,080,158 | 3/1978 | Kondo et al. | 432/59 |
| 4,121,888 | 10/1978 | Tomura et al. | 355/3 FU |
| 4,160,595 | 7/1979 | Ito et al. | 355/3 FU |

FOREIGN PATENT DOCUMENTS

| | | | |
|---|---|---|---|
| 2505416 | 8/1976 | Fed. Rep. of Germany | 355/3 FU |
| 54-126546 | 10/1979 | Japan | 355/3 FU |
| 54-126547 | 10/1979 | Japan | 355/3 FU |
| 54-126548 | 10/1979 | Japan | 355/3 FU |

*Primary Examiner*—R. L. Moses

*Attorney, Agent, or Firm*—Joscelyn G. Cockburn; Francis A. Sirr

[57] ABSTRACT

A flash system for fusing or fixing thermoplastic resin such as toner onto an image support sheet includes a pair of flash fusing assemblies disposed in side-by-side relationship. Each assembly includes a reflector with a flash lamp positioned within said reflector. The flash lamps are coupled in parallel to a common energy charging source. The flash lamps are triggered alternatively so that each section of the support sheet is fused by a different lamp. In an alternate embodiment, a single lamp is moved at one half the speed of the support sheet. The lamp is triggered sequentially to fuse the entire sheet.

7 Claims, 6 Drawing Figures

DUAL FLASH FUSER REFLECTOR WITH ALTERNATING FLASH FOR POWER REDUCTION

BACKGROUND OF THE INVENTION

1. Field of the Invention

The invention relates to heating devices for fixing toner onto a copy sheet. More particularly, the invention relates to a flash fusing device for fixing the toner.

2. Prior Art

The use of flash fusing devices for fusing toner particles adhering to a latent electrostatic pattern on a dielectric recording medium, such as paper sheets, is well known in the prior art. Such a flash fusing device consists of a reflector which directs radiation generated from a flash lamp onto the surface of the recording medium carrying the toner particles. The energy associated with the radiation is of sufficient magnitude to heat the toner into a molten state while the characteristics of the recording medium are substantially unaffected.

The molten toner penetrates into the fiber of the recording medium. Upon subsequent cooling, the toner image becomes indelibly fixed into the medium to form a permanent copy.

U.S. Pat. No. 3,445,626 to Thomas B. Michaels exemplifies the prior art fusing devices. The Michaels' patent describes a fusing assembly consisting of a xenon gas lamp and reflector assembly. The lamp and reflector are arranged in a conventional manner and disposed relative to a copy sheet transport device. A paper sensing device is disposed at the entry side of the fusing assembly. As a sheet is transported under the xenon lamp/reflector assembly, the leading edge of the sheet activates the sensing device and a signal is generated therefrom. The signal initiates a timing circuit to permit movement of the detected sheet or card to a second position relative to the fusing assembly, at which time the flash lamp is triggered to fix the toner pattern on a section of the card. A logic interlock circuit permits the flash lamp to remain untriggered in the absence of any card to be fused. The interlock circuit also provides for successive triggering of the flash lamp in order to fuse an entire card.

U.S. Pat. No. 3,871,761 is another example of the prior art flash fuser. The fuser consists of a flash lamp mounted within the cavity or interior of a radiation reflector. The reflector and the flash lamp are mounted above a paper transport. A copy sheet carrying a toned image is advanced under the fuser by the paper transport. As the sheet passes under the fuser, the flash lamp is repeatedly triggered. By triggering the flash lamp repeatedly, a plurality of flashes are generated. The plurality of flashes are used to fuse the toned image onto the copy sheet.

U.S. Pat. No. 4,121,888 describes another prior art flash fuser. In this system a single flash is utilized for fixing toner onto a copy sheet. The fuser consists of a flash lamp mounted within a reflector. The opening of the reflector faces a copy sheet paper path. Copy sheets carrying toned images are transported along the paper path. The dimension of the opening is equivalent to the dimensions of a conventional or typical copy sheet. As such, when a copy sheet is aligned with the opening, a single flash from the flash lamp fuses the entire sheet. Sensor means is provided to activate the flash lamp when the sheet is positioned in proper alignment with the opening. The flash is initiated by a triggering circuit.

A power supply charges a capacitor which supplies energy to sustain the flash.

One of the main problems associated with the prior art flash fusers is that the power supplies are unduly large, bulky and expensive to manufacture. Usually these large power supplies require a relatively large quantity of energy.

As is well known, the flash fuser is one of the plurality of elements used in an electrophotographic copier. As such, the flash fuser, power supply, charging and triggering circuits are housed in the frame of the copier. The miniaturization of copiers appears to be the trend for copier designers. There is also a requirement that miniature copiers be low cost and utilize a relatively low quantity of energy for operation. Due to the bulkiness and high cost of the prior art power supplies, they are not suitable for use in miniaturized copiers.

Even in stand-alone (large size) copiers, the use of flash fusing appears to be restricted. It is believed that the restrictive use stems from the adverse characteristics of the power supply.

As is evident from the above description of the prior art, either a single flash is used to fuse a page or multiple flashes are used to fuse a single page. In either case, a single flash fuser device (that is a reflector and a flash lamp) is used to generate the flashes. When a single flash is used, the effective fusing area must be at least equivalent to the size of the sheet. Needless to say that as the size of the sheet increases, the effective fusing area and hence the energy requirement of the fusing system increases. In order to meet the high energy requirement in a single flash system, the power supply, charging capacitor and related electrical circuits and/or components must be increased accordingly. In order to generate a fixed number of copy sheets per unit time, a sheet must be fused within a relatively short period of time, say a fraction of a second.

Generally, the rating of electrophotographic copiers is based on the number of copies that are generated per unit time. To meet a particular rating or throughput, the fuser must fix a certain number of copies per unit time. By way of example, if minute is the per unit time for copier rating, then second is the per unit time for fuser rating. In order to meet this rating, when multiple flashes are used to fix a copy sheet, the frequency of this flash is relatively close. This means that the time interval between flashes is relatively short. As was stated previously, each flash fuser requires an energy supply source to supply energy to the flash lamp. Usually, the energy supply source includes a power supply and an energy storage device such as a capacitor. The capacitor dumps stored energy into the flash lamp while the power supply charges the capacitor. Obviously, the shorter the time interval between flashes, the more powerful a power supply is needed. In order to be sure that the necessary energy is available to charge the capacitor within the relatively short time interval, the power supply is over designed. This leads to the unusually large size power supplies which are used with prior art flash fusing assemblies.

SUMMARY OF THE INVENTION

It is therefore the object of the invention to provide a more efficient flash fuser assembly than has heretofore been possible.

It is another object of the present invention to provide a flash fuser assembly which requires a lower energy consumption than has heretofore been possible.

It is yet another object of the present invention to provide a low cost flash fuser assembly.

It is a further object of the present invention to provide a flash fuser assembly which utilizes a relatively small power supply to generate the energy requirement of the system.

The present invention solves the prior art enumerated problems by providing a flash fuser assembly including a pair of flash lamps mounted in side-by-side relation and spaced from the copy paper path of an electrophotographic copier machine. A reflective shade is placed relative to each flash lamp. The configuration between each flash lamp and its reflective shade is such that as the lamp flashes, the energy associated with the flash is incident onto a copy sheet traversing the paper path. Each flash is initiated by a triggering circuit. The triggering circuit is coupled to the flash lamp. The triggering circuit is controlled so that the flash lamps are triggered alternately. By triggering the flash lamps alternately, alternate flashes are generated. The alternate flashes are used to fuse or fix toner onto a single copy sheet.

In an alternate embodiment of the present invention, the flash fusing device includes a single flash lamp mounted within the cavity of a reflective shade. The device is mounted so that the opening in the shade faces the copy paper path. The device is coupled to a carriage assembly which moves the device in the direction of copy sheet travel but at a speed slower than the speed at which the copy paper is transported. As a copy sheet is positioned in alignment with the opening, the lamp is triggered to generate a flash. The flash fuses a portion, say one-half of the copy sheet. The fusing device and sheet are transported in the same direction but at different velocities. The lamp is again triggered to fuse the remaining section of the sheet. By transporting both the sheet and the fusing device, the time between flashes is effectively increased.

The foregoing and other features and advantages of the invention will be apparent from the following more particular description of a preferred embodiment of the invention, as illustrated in the accompanying drawings.

DETAILED DESCRIPTION OF THE PREFERRED EMBODIMENT

Figure 1:
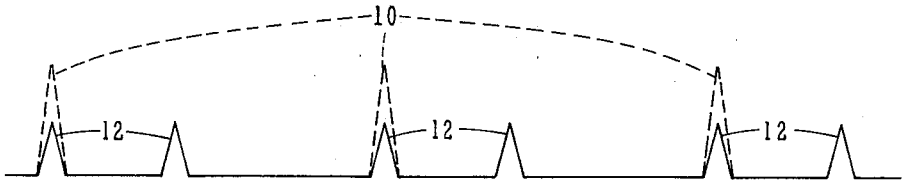
FIG 1 PRIOR ART
FIG. 1 shows a plot of energy pulses versus the frequency of said pulses for fusing toner with a prior art fuser. This plot is helpful in understanding the energy requirements of prior art fusing systems.

FIG. 1 shows a graph of the energy requirement for the prior art flash fusing assembly. In this figure, the quantum of energy is plotted against the ordinate of the graph, while time is plotted along the abscissa. As was pointed out above, the prior art uses a single flash to fuse or fix a full size page or a plurality of flashes; usually two, to fuse a typical page. The quantum of energy which is needed to fuse a typical page with a single flash is identified by numeral 10 while the quantum of energy which is needed to fuse a page using two flashes is identified by numeral 12. As is evident from the drawing, when a single flash is used to fuse a document, a relatively high quantum of energy is needed. When two flashes are used to fuse a typical page, the quantum of energy needed in each flash is less than the quantum of energy needed in a single flash. However, the frequency with which the two flashes are needed are relatively short. As a result of the short period between flashes, the power supply circuitry has to be designed to deliver the needed quantum of energy within a relatively short period of time. To this end, whether the prior art uses a single flash with large energy requirements to fuse a typical page or dual flashes within a short time period, to fuse the typical page the energy requirement and hence the power supply and associated circuit have to be designed oversize and hence the problem with the prior art devices.

By way of example, assume that an electrophotographic copying system generates 75 copies per minute with a process speed of 20.6 inches per second. To meet this throughput, a sheet of paper must be fed to the fusing station of the machine every 0.8 seconds. For a typical size sheet, say $8\frac{1}{2}\times 11''$ or $8\frac{1}{2}\times 14''$, and processed in the $8\frac{1}{2}''$ direction, spacing between sheets is approximately 8". Further, assume that a fusing system is designed with a $4\frac{1}{4}''$ wide reflector using two flashes in quick succession. The time to move the paper $4\frac{1}{4}''$ after the leading half of the paper has been flashed is equivalent to: 4.25 inches÷20.6 inches/sec. or 0.206 seconds. Stated another way, for fusing the sheet, two flashes are required within 206 ms (milliseconds) apart. To satisfy the requirement of the system using the prior art flash fusing apparatus and flashing scheme, a power supply must be designed to handle the 206 ms rate. At 206 ms between flashes, the power supply would be required to deliver:

$$\frac{400\text{ joules}}{\text{flash}} \times \frac{1}{.206}\ \frac{\text{flash}}{\text{sec.}} = 1942\ \frac{\text{joules}}{\text{sec.}} = 1942\text{ watts}$$

It should be noted in the above calculation that a typical sheet requires 400 joules per flash for fusing a half page. As is obvious from the above calculation, the power supply must be designed to deliver 1942 watts of energy per flash. It should be noted in FIG. 1 that the first two energy pulses each identified by numeral 12 are needed for fusing a single sheet. After that sheet is fused, there is a relatively long period of time until another two flashes are outputted to fuse a second sheet traversing the paper path.

Figure 2:
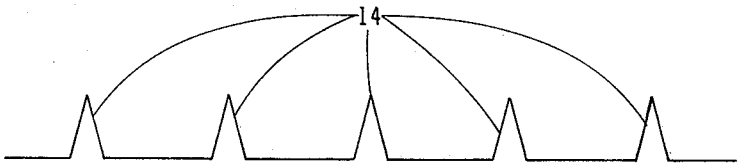
FIG. 2 shows a plot of energy pulses versus frequency of the pulses for the fusing system of the present invention. The plot is helpful in understanding energy requirements of the present invention.

The present invention minimizes the energy requirement of the prior art fusing system shown in FIG. 1 by spacing the flashes more evenly. FIG. 2 is a sketch showing the energy requirement of a flash system utilizing the present invention. In FIG. 2, the vertical axis of the graph represents the quantum of energy needed per flash while the horizontal axis of the graph represents time. As can be seen from the energy representation in FIG. 2, the energy pulses needed for fusing a page are farther apart than in FIG. 1 and, as such, the power supply can be significantly reduced without sacrificing process speed etc. By way of example, assume that the flash fusing system having an energy requirement as that shown in FIG. 2 is used to fuse copy sheets on a copier identical to the hypothetical system described in relationship with FIG. 1 above. As before, it is assumed that each flash delivers an energy of 400 joules. Then the energy requirement of the power supply needed to drive a flash fusing system so that the energy pulses are spaced as is shown in FIG. 2 is equivalent to:

$$\frac{400 \text{ joules}}{\text{flash}} \times \frac{1}{.400} \frac{\text{flash}}{\text{sec.}} = 1000 \frac{\text{joules}}{\text{sec.}} = 1000 \text{ watts}$$

By comparing the energy requirement for the fusing system shown in FIGS. 1 or 2, it can be seen that the power supply for the charging system of the present invention is significantly less than that of the prior art.

Figure 3:
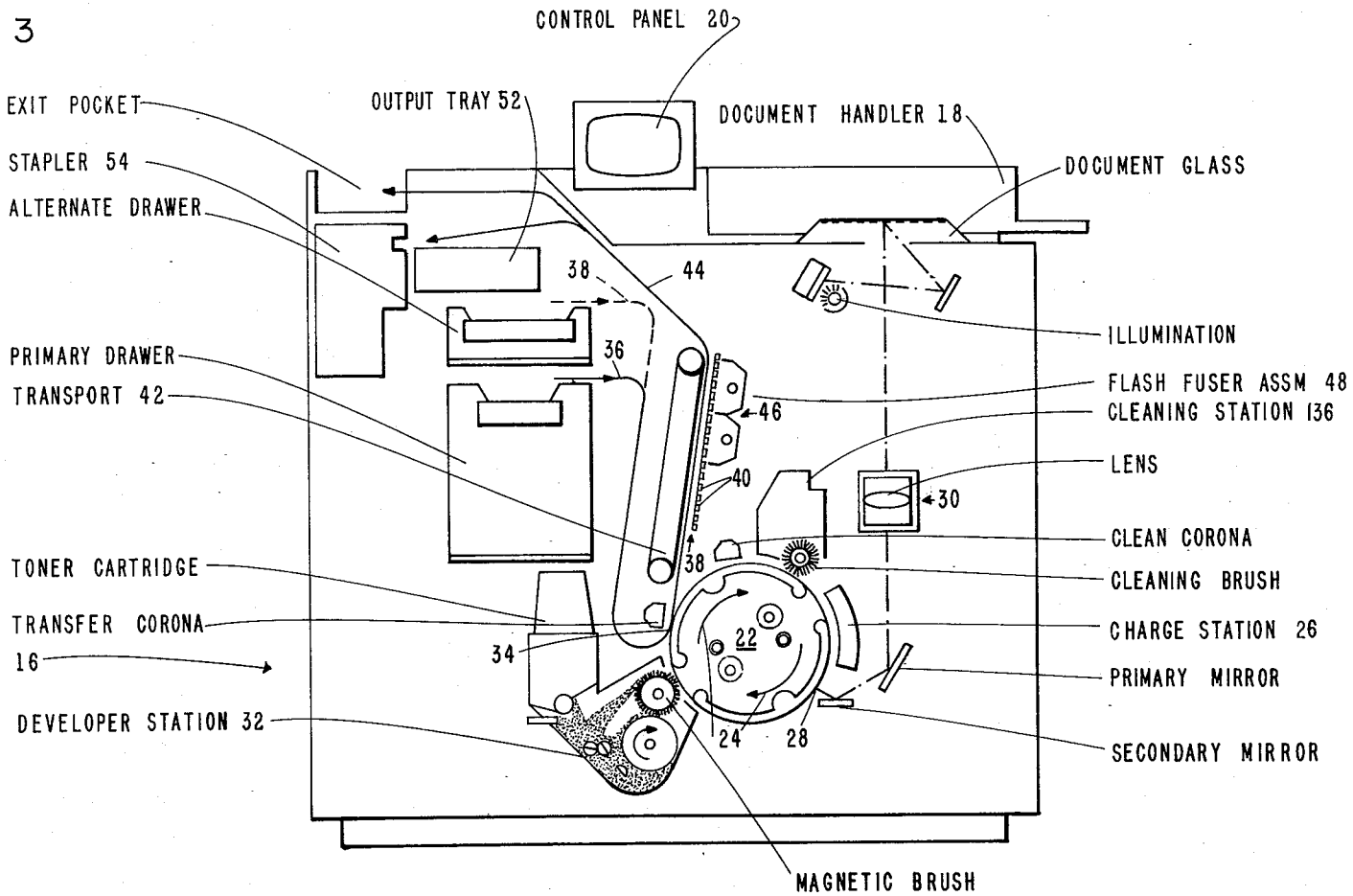
FIG. 3 shows an electrophotographic copier with a flash fusing device according to the present invention. The flash fusing device is disposed at the fusing station.

FIG. 3 shows an electrophotographic copying system which includes a flash fusing station with a flash fuser according to the teaching of the present invention. The electrophotographic copying system includes a copier processing engine 16, a document handler 18 and a copier control panel 20. The document handler 18 is mounted to the frame of the copier processing engine. The document handler is disposed over the document glass of the copier processing engine. The function of the document handler is to present original documents for copying to the document glass of the system. The use of the document handler with the copy processing engine is well known in the prior art and therefore details of the document handler will not be given.

Similarly, the copier control panel 20 is mounted to the frame of the copier processing engine 16. The function of the copier control panel allows an operator to communicate with the copier processing engine. By way of example, an operator can enter the number of copy sheets which the system must generate. Also, if the operator needs collated sets of copies, that information is inputted from the control panel to the system. As with the document handler, the use of copier control panel on convenience copiers are well known in the art and details will not be given further.

The copier processing engine 16 includes a photoconductor drum 22 which is journaled for rotation in the direction identified by arrow 24. The photoconductor drum is a conventional drum with a photosensitive layer disposed on the external surface of the drum. A plurality of copier processing stations are disposed about the periphery of the drum. Taken in order around the drum, preferably in the direction of drum rotation, the stations include a charge station 26. The function of the charge station is to charge the photosensitive layer to an operating voltage level. Downstream from the charge station 26 is the imaging or exposure station 28. At the imaging station, a latent image of a document at the document glass is deposited on the photoconductor layer by optical system 30. Both the imaging station and the optical system are conventional elements of a convenience copier and details will not be given. Downstream from the imaging station 28 is the development station 32. The development station 32 is fitted with a supply of microscopic toner and a magnetic brush which transfers the toner from the development station to form a visible image of the latent image which was deposited on the photosensitive layer of the photoconductor by imaging station 28. Downstream from the developer station is the transfer station 34. The transfer station is fitted with a transfer corona. At the transfer station, a developed image is transferred from the photoconductor drum to a copy sheet. The copy sheet is picked from primary drawer or the alternate drawer and is transported along the paper path shown by arrow 36 or 38 to the transfer station. At the transfer station, the developed image on the photoconductor is transferred onto the paper by means of the transfer corona. As before, the operation of a transfer corona to transfer a microscopic toner image from a photoconductor onto a paper sheet is well known in the prior art, and as such, details of the transfer station will not be discussed. Downstream from the transfer station 34 is the cleaning station 136. As before, cleaning stations are well known in the prior art and details will not be given here. Suffice it to say that this cleaning station includes a cleaning corona and a cleaning brush. The function is to clean the residual toner from the photoconductor. The photoconductor which is now clean, moves under the charge station 26 and the process is repeated.

Still referring to FIG. 3, the toned image which was developed on the photoconductor is transferred at the transfer station to paper 38. The transferred image is formed by unfused toner which is identified by numeral 40. As is evident from the drawing, a plurality of microscopic unfused toner is now positioned on the transfer paper 38. As the paper with the unfused toner leaves, that is exits, the transfer station it is accepted by the transport means 42. The paper and unfused toner is transported along copy sheet paper path 44 into the fusing station 46. The fusing station 46 includes a flash fuser assembly 48. The function of the flash fuser assembly 48 is to fuse microscopic toner onto the toner image carrying sheet, such as sheet 38, as they are transported by transport means 42 through the flash fuser assembly.

As will be explained in greater detail, the flash fuser assembly includes a dual multifaceted reflector shade and a plurality of flash bulbs or lamps mounted in the cavities of said shade. As the paper is moved under the flash lamps in the direction of paper motion identified by arrow 38, the lamps are triggered alternately and a plurality of flashes are outputted to fuse the toner onto the sheet. The sheet is then transported into the exit pocket or onto output tray 52 where it can be stapled by stapler 54 and a pile of stapled sets are outputted on the tray.

Figure 4:
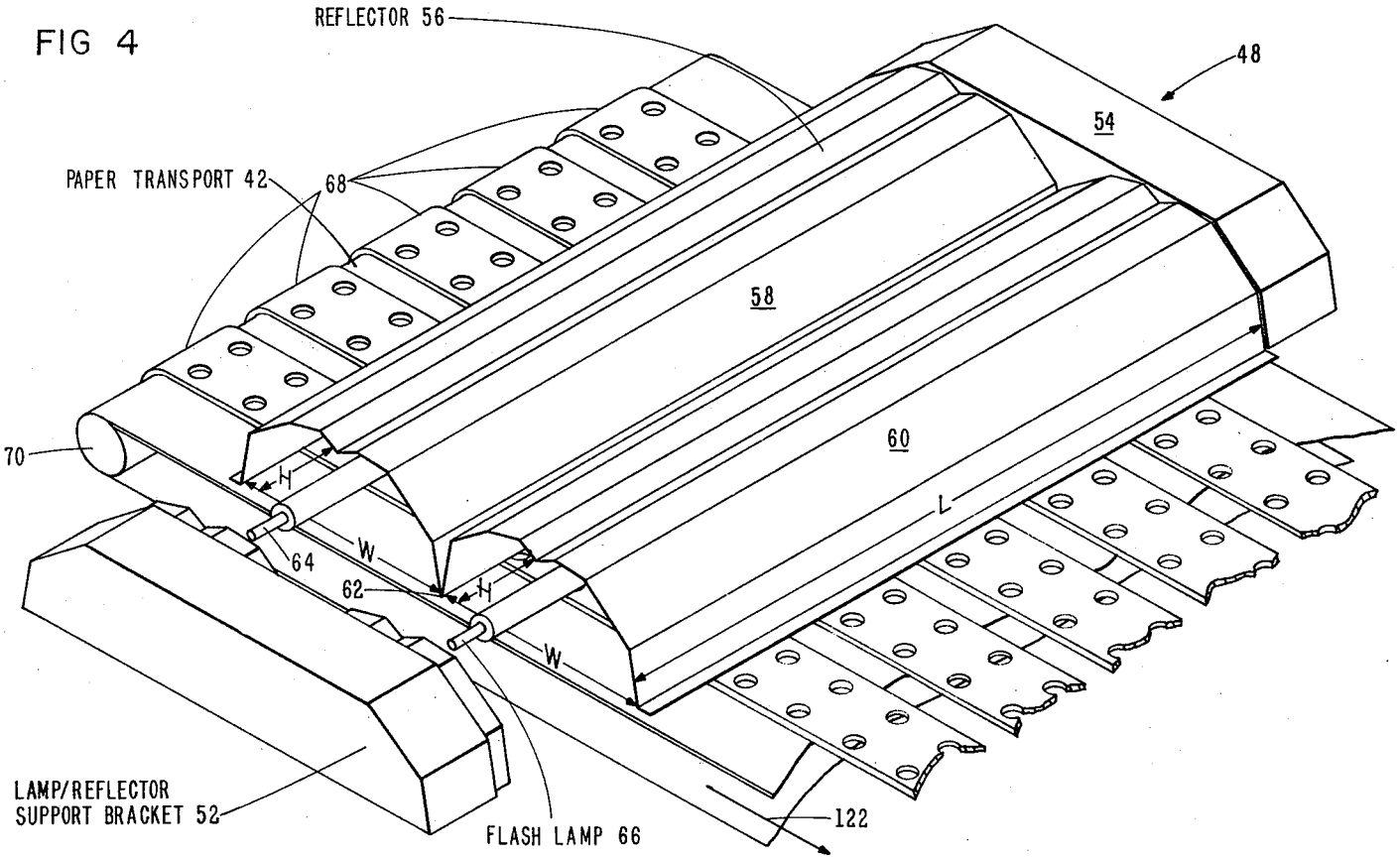
FIG. 4 shows an exploded isometric view of the flash fusing device of FIG. 3.

Referring now to FIG. 4, an exploded view of the flash fuser assembly 48 is shown. The flash fusing assembly 48 includes a pair of lamp reflector support brackets identified with numerals 52 and 54, respectively. The lamp reflector support brackets are disposed in spaced relationship and are coupled to each other by a dual bay reflector 56. The dual bay reflector is formed from two single reflectors identified by numerals 58 and 60, respectively. The independent reflectors are joined along line 62. It should be noted that the reflector need not be of a dual bay construction. Instead, two independent noncoupled reflectors can be used to replace the dual bay reflector. The noncoupled reflectors may be placed relatively close to each other or may be placed in spaced relationship. Each reflector is fabricated from a plurality of planar elongated sections of reflective material. The size and width of each section varies in accordance with a predetermined design. This enables the energy distribution, on the surface below the reflector, to be even. Additionally, the energy distribution is further aided by carefully selecting the angles at which the sectors are positioned relative to one another. The internal surfaces of each sector are polished and a layer of reflective material such as aluminum is deposited thereon. Although the width of the reflector can be variable, in the preferred embodiment of this invention the width W of each reflector is approximately 4.38 inches wide. The height (H) of each reflector is approximately 1.94 inches. The length (L) of each of the shades is approximately 14.5 inches. Of course, any other dimension can be used without departing from the scope of the present invention. In the actual device, reflector support brackets 52 and 54 are coupled to opposite sides of the reflector. However, in FIG. 4 reflector bracket 52 is shown in detached form to show the position of flash lamps 64 and 66, respectively. In the preferred embodiment of the present invention, the flash lamps 64 and 66 are conventional xenon flash tubes. Xenon flash tubes are well known in the prior art, and as such, will not be described in detail. Suffice it to say at this point, that each of the xenon tubes are filled with an inert gas under a predetermined pressure. A deposited voltage rod or laced wire runs along the longitudinal surface of each lamp. When a voltage, called the triggering voltage, is applied to the rod or wire, it begins to conduct. Simultaneously, a sustenance voltage is applied to the lamp. This causes the inert gas to ignite and as such a high energy flash is generated from the lamp. The flash from the lamp contains sufficient energy to fuse the toner onto a sheet transported under the lamp.

Still referring to FIG. 4, each of the reflector support brackets is fitted with electrical sockets (not shown). The flash bulbs are fitted into the electrical sockets. Electrical conductors (not shown) interconnect the lamp to the outside electrical circuit which supplies the triggering voltage and the sustenance energy to the lamps. A paper transport means 42 is disposed in spaced relationship to the lamps. Although any appropriate type of paper transport means can be used to transport paper under the lamp, in the preferred embodiment of this invention, it is of the vacuum belt type. This type of paper transport includes a plurality of endless belts identified by numeral 68. The belts are fitted with a plurality of vacuum holes. A pair of elongated rollers, only one of which is shown in FIG. 4 and identified by numeral 70, is mounted in spaced relationship. One of the rollers is an idler roller and the other is driven by a servo-controlled DC motor (not shown). The motor is further fitted with a tachometer which can be used to output position information and directional information. By controlling the motor, a sheet which is attached to the belt can be positioned at any point under the flash lamps. A vacuum plenum (not shown) is disposed between the two rollers. When a negative pressure is applied to the plenum, the holes in the belt convey this negative pressure to the atmosphere and a sheet that is delivered to the belt is held firmly as it is transported through the fuser assembly.

Figure 5:
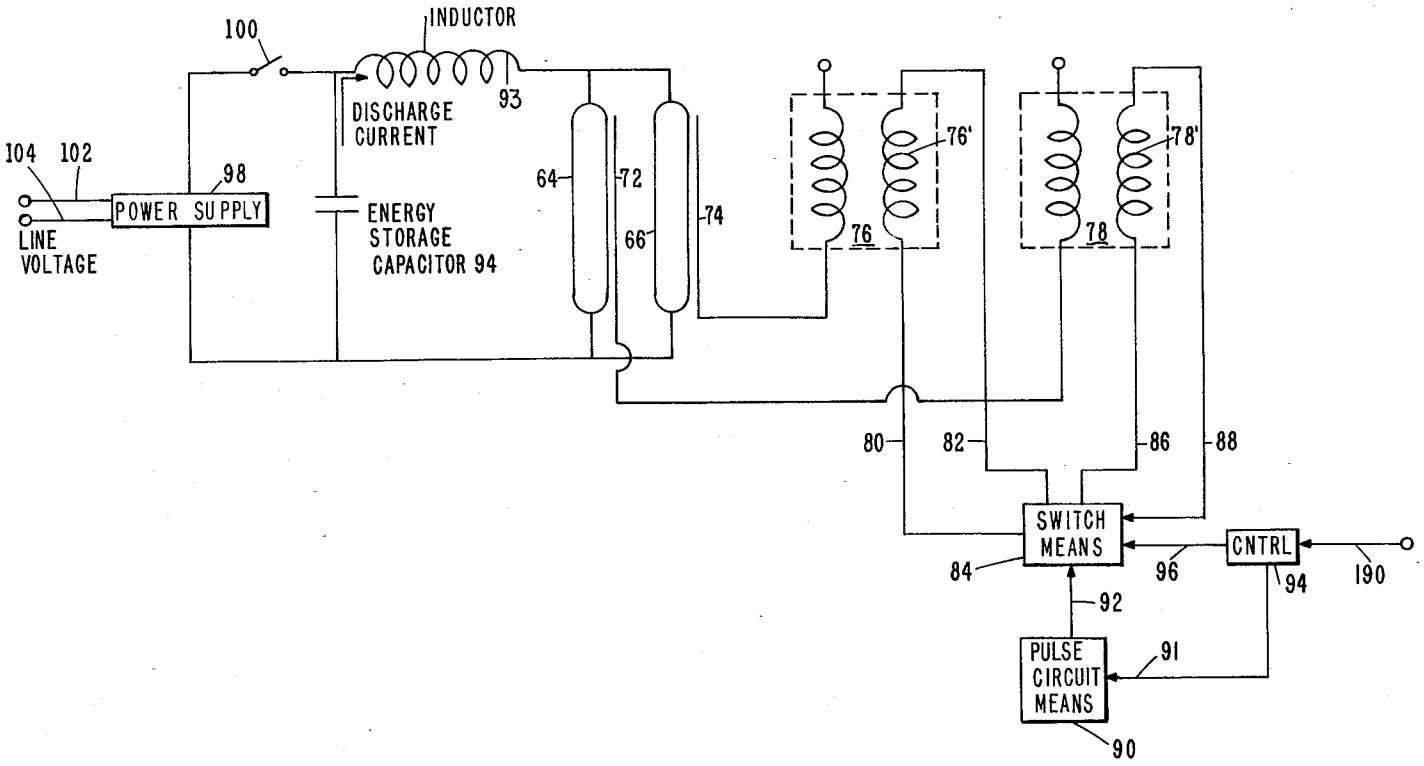
FIG. 5 shows an electrical circuit means which controls the flash tubes of the fuser.

FIG. 5 shows an electrical circuit means which drives the flash lamps so that these lamps are fired or discharged alternately to fuse a sheet. The flash tubes 64 and 66 are connected in a parallel arrangement. A parallel triggering wire is coupled to each tube. The trigger wire associated with tube 64 is identified as trigger wire 72 and the trigger wire which is associated with flash tube 66 is identified by numeral 74. Each of the trigger wires is coupled to independently triggering circuit means identified by numerals 76 and 78, respectively. Although a plurality of triggering circuit means can be used, in the preferred embodiment of this invention triggering circuit means 76 and 78 are transformers. As was stated previously, the function of the triggering transformers is to apply a voltage pulse to its associated parallel trigger wire. This pulse initiates the arc which generates the flash in each of the xenon flash tubes.

Figure 6:
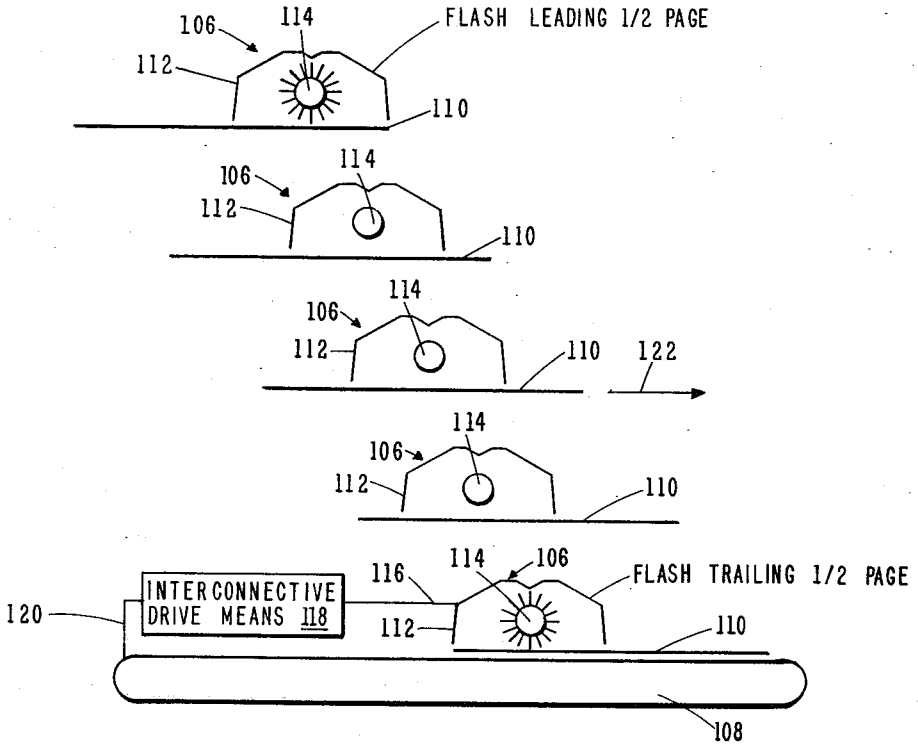
FIG. 6 shows a schematic of an embodiment in which the fusing device is moved relative to a copy sheet.

Still referring to FIG. 6, the primary winding 76' of the transformer is coupled by conductors 80 and 82 respectively to a conventional electronic bipolar switching circuit means 84. Likewise, primary winding 78' is coupled to switching circuit means 84 by conductors 86 and 88 respectively. A conventional pulse forming circuit means 90 is coupled over conductor 92 to switching circuit means 84. As will be explained subsequently, the function of the pulse generating circuit means 90 is to generate the pulse which is used to initiate conduction in the flash tubes. The pulse circuit means 90 is a conventional circuit means which can be purchased off the shelf.

The pulse circuit means 90 is enabled by a controlled signal outputted on conductor 91 by controller 94. The controller 94 also outputs a control signal on conductor 96. The signal on conductor 96 is used to interconnect the pulse circuit means 90 with the selected trigger transformer. The controller 94 generates timing signals which enable pulse circuit means 90. As was stated previously, the pulse circuit means 90 generates a pulse which initiates the sequence which results in the flashing of the xenon tubes. In addition to initiating the timing signal which is outputted on conductor 92, the control 94 outputs control signals on conductor 96. The signal on conductor 96 controls switching circuit means 84 so that the switch is alternately coupled to conductors 80 and 82 and conductors 86 and 88. When the switch is coupled to conductor 80 and 82, the pulse outputted from pulse circuit means 90 activates trigger transformer 76. Similarly, when the switch is coupled to conductor 86 and 88, the pulse outputted from pulse circuit means 90 is coupled to trigger transformer 78. A series of enabling pulses are fed into controller 94 over conductor 190. The pulses on conductor 190 are generated in timed relationship with the position of the photoconductor drum 22, FIG. 3, relative to the processing station. By knowing the position of the drum relative to its associated processing station and the process speed of the system, the controller 94 generates the necessary timing pulse which initiates the pulse circuit means 90 and controls the switch to activate the proper trigger transformer. By way of example, IBM manual covering the Series III copier, discloses an apparatus and method for timing the position of the photoconductor drum relative to its processing station. The apparatus includes an emitter wheel and sensors. The apparatus and method used is applicable to generate the signal on conductor 190. This manual is identified as "IBM Series III Copier/Duplicator Service Manual" #241-5928-0. U.S. Pat. No. 4,025,186 gives another timing scheme which generates appropriate timing signals which can be used on conductor 190 for initiating the fusing station. In that patent, timing holes are positioned on the photoconductor belt and the signals generated by the holes are used to generate control signals which activate the proper processing station in timed relationship with the function to be performed.

Although it is within the skill of the art to use a discrete circuit for generating the appropriate control circuit 94, in the preferred embodiment of this invention the controller 94 is a microcomputer. By way of example, the Motorola M9800 microcomputer will be suitable. Such a microcomputer is available with its own set of instructions, and it is within the skill of the art to program the microprocessor to output the necessary control signals on conductor 91 and 96 respectively. As such the details of the microprocessor programming will not be disclosed.

Still referring to FIG. 5, an inductor 93 is coupled to flash tubes 64 and 66 respectively. The function of the inductor is to minimize ringing in the current waveform which is supplied to the flash tubes. An energy storage capacitor 94 is connected in series with the inductor. The series connected energy storage capacitor 94 and the inductor 93 is referred to as the flash sustenance circuit means. As will be explained subsequently, as soon as the trigger transformer initiates the arc or breakdown in one of the flash tubes, the energy which is stored in the capacitor 94 is dumped into the selected flash tube to generate the flash which creates the energy for fusing a copy sheet. The capacitor is charged by power supply 98. While a conventional switch 100 couples the power supply to the capacitor, line voltage is inputted to the power supply over conductor 102 and 104.

In operation, the timing pulse is generated on conductor 190. As stated previously, the pulse represents the position of the photoconductor layer relative to the processing stations. The controller 94, which is a microcomputer, initiates a timing routine which outputs a control signal on conductor 91. The signal on conductor 91 is utilized by pulse circuit means 90 to generate a trigger pulse which is outputted on conductor 92. The controller 94 also initiates a control pulse on conductor 96. The pulse is utilized by switch means 84 to interconnect the proper trigger transformer with conductor 92. With the proper trigger transformer in electrical communication with pulse circuit means 90, the selected trigger transformer initiates conduction in one of the flash tubes 64 and 66 respectively. The selected flash tube is now in the conduction mode and the energy which is stored in energy storage capacitor 94 is dumped into said tube through inductor 93. Charging of the capacitor is affected by power supply 98 via switch 100. When the capacitor is properly charged, the switch disconnects the power supply therefrom. The fusing process, that is charging and flashing, is performed alternately between flash tube 64 and 66 respectively until the system is turned off.

FIG. 6 shows sketches for an alternate embodiment of the present invention. In this embodiment, a fusing device 106 is mounted relative to the copy paper path of an electrophotographic copier. A copy sheet transport means 108 is disposed parallel with the paper path. The function of the transport means is to transport a copy sheet 110 along the paper path and under the fusing device for fusing. The fusing device 106 includes a multifaceted reflector 112 and a flash lamp 114 disposed within the cavity of the reflector. The fusing device is coupled to a conventional carriage assembly (not shown). The carriage assembly is coupled through mechanical means 116 to an interconnective drive means 118. The interconnective drive means 118 is coupled through mechanical means 120 to the paper transport means 108. The function of the interconnective drive means 118 is to control the paper transport means 108 and the carriage transporting the fusing device 106 so that the fusing device and the paper transport means 108 is moved in a common direction identified by arrow 122. However, the velocity of the fusing carriage assembly is less than the velocity at which the paper is transported. In the preferred embodiment of the present invention, the fusing assembly is transported at ½ the velocity of the paper. It is well within the skill of the art to design an interconnective drive means which will generate the requisite velocity to the paper transport 108 and the fusing device 106. By way of example, the interconnective drive means 118 may be a cam assembly which has a cam surface and appropriate cam followers to impart the requisite motion to the fuser device and to the paper transport. Alternately, the fusing device can be driven by a servo-control stepping motor having a conventional two-phased tachometer mounted on its shaft. Similarly, the paper transport assembly 108 can be driven by a servo-control stepping motor having a conventional two-phased tachometer mounted on its shaft. By monitoring the position of each motor by means of its associated tach, the motors can be controlled or synchronized so that the requisite speed is imparted to the flash fusing device and to the paper transport means.

In operation, a sheet having thermoplastic microscopic toner image is transported by the paper transport means 108 so that the surface of the sheet carrying the untoned image faces the fusing assembly. Viewing the sketches in FIG. 6, from top to bottom, the first sketch shows the sheet 110 positioned under the fuser device. With the first half of the sheet in alignment with the fuser, the single fuser is activated and bulb 114 generates a flash. The flash is indicated by the radial lines extending from the circle. The flash is sufficient to fuse the first half of the image on the page. The second sketch shows the flash lamp in the off condition and the paper and the lamp moving at relative speed in the direction shown by arrow 122. The third and fourth sketches show continued relative motion between the fusing device 106 and the paper 110 carrying the unfused image. However, since the paper is moving at a higher velocity than the fusing device, the unfused half of the sheet will be positioned in alignment at some later time with the fuser. This condition is shown in the last sketch in the figure. In that sketch the unfused half of the page is now in alignment with the flash lamp. The lamp is again triggered which results in a flash and the second half of the page is fused. It should be noted that the time which elapsed between the first flash identified by the first sketch and the second flash identified by the last sketch, is used to recharge the capacitor which generates the energy for the flash lamp. With this configuration, although multiple flashes (preferably two) are used to fuse a single sheet, the frequency of the flashes is significantly longer, and as a result, a relatively small and inexpensive power supply can be used for charging the capacitor. It should also be noted that although the interconnective drive means 118 and the paper transport means 108 are only shown in association with the last sketch, the interconnection and paper transport are associated with each of the sketches in the figure. However, for brevity, the interconnective drive means and the paper transport means are shown only with the last sketch.

Still referring to FIG. 6, the method used to fuse the toner particles onto copy sheet 110 using a single flash fusing device with multiple flashes may be summarized as follows:

(A) A paper path along which the copy sheet is to be transported is defined.

(B) A flash fusing device including a flash bulb and a reflective shade is disposed relative to the paper path.

(C) A transport mechanism is positioned so that it moves the sheet in a forward direction along the paper path and under the fusing device.

(D) The copy sheet is then transported along the paper path.

(E) A flash is generated from the fusing device to fuse a portion of the copy sheet.

(F) Transporting the flash fusing device and the paper in the same direction with the velocity of the fusing device less than the velocity of the sheet.

(G) Flashing the flash fusing device when another unfused section of the sheet is under the device.

(H) Performing the steps (F) and (G) until the entire sheet is fused.

FIGS. 4 and 2 can also be used to describe the apparatus and method used in the first embodiment of this invention to fuse a copy sheet. As was stated previously, a plurality of flashes, preferably two flashes are used for fusing a copy sheet. As is shown more particularly in FIG. 2, the flashes are spaced with relatively long time intervals between. As such, the power supply needed to supply the energy can be designed with relatively small size and relatively low cost. With reference to FIG. 4, in operation, a sheet carrying a fixed image is transported by the paper transport 42 in a direction shown by arrow 122. When a first section of the sheet is positioned under flash lamp 64, the flash lamp is triggered and the flash from the lamp is focused by the reflector onto the sheet for fusing that section. Preferably, the lamp is flashed when the section of paper under the lamp is equivalent to the width of the shade or reflector. After fusing, the sheet is transported under the lamp until an unfused section equivalent to the width of reflector 60 is positioned under lamp 66 of the fuser. At this point, the flash lamp 66 is triggered and the unfused portion is now fused. As is evident in FIG. 2, by firing the lamps alternately, the time interval between flashes increases, and as such, the requirement for the power supply is significantly reduced. It can be seen from FIG. 4 that once a paper path is defined relative to a pair of flash lamps positioned in side-by-side relationship and the lamps are triggered alternately until a sheet is fused, the power components and circuitry which supply energy to the lamps are significantly reduced.

While the invention has been particularly shown and described with reference to preferred embodiments thereof, it will be understood by those skilled in the art that various changes in form and details may be made therein without departing from the spirit and scope of the invention.

What is claimed is:

1. A flash fusing apparatus operable to fix toner onto copy sheets outputted from an electrophotographic copier, said fusing apparatus comprising in combination:

a movable fusing assembly comprising of a flash lamp disposed within the cavity of a reflector;

a sheet transport means disposed in spaced relation with the fusing assembly, said sheet transport means being operable to transport a sheet carrying an unfixed toner image for fusing by said fusing assembly;

a carriage assembly means operable to transport the fusing assembly;

a circuit means operable to energize the flash lamp intermittently so that a copy sheet is being fused by intermittent flashes; and a speed controller means operable to control the sheet transport means and the carriage assembly means so that the relative velocity of the carriage assembly means is less than the relative velocity of the sheet transport means.

2. A flash fusing device for fusing toner onto a recording sheet, said device comprising in combination:

a pair of xenon flash tubes coupled in a parallel configuration;

an inductor connected to the tubes;

a capacitor connected in series with the inductor;

a power supply operable to charge the capacitor;

a pair of trigger transformers each having a pair of its terminals coupled to one of the xenon flash tubes;

a switch operably coupled to the transformer;

a pulse generating circuit operably coupled to the switch; and a controller for enabling the switch so that an initiating pulse outputted from the pulse generating circuit activates the transformer to trigger the flash tubes alternately.

3. The device of claim 2 further including a transport means for transporting the copy sheet within the effective fusing zone of the flash tubes.

4. A method for fixing an electroscopic powdered image to a copy sheet comprising of the following steps:

(1) defining a copy sheet paper path;

(2) positioning a flash fusing device in spaced relation with the paper path;

(3) transporting the copy sheet along the paper path;

(4) generating a flash from the fusing device as soon as a first unfused portion of the electroscopic powdered image is in alignment with the flash fusing device;

(5) transporting the flash fusing device along a path mirroring that of the copy sheet;

(6) flashing the fusing device as soon as a second unfused portion of the electroscopic powdered image is in alignment with the flash fusing device;

(7) repeating steps (4) through (6) until the entire electroscopic powdered image is fixed.

5. The method set forth in claim 4 wherein the copy sheet and the flash fusing device are transported in the same direction.

6. The method set forth in claim 5 wherein the flash fusing device is transported at a lower velocity than the velocity of the copy sheet.

7. A device for fixing thermoplastic particles onto a support sheet, comprising:

a plurality of flash illumination means disposed in side-by-side relationship and in spaced alignment with a copy sheet paper path, each individual one of said flash illumination means having a reflector associated therewith, said flash illumination means being operable to fix the thermoplastic particles onto said support sheet;

a single energy supply operable to energize the flash illumination means;

control circuit means operable to trigger the individual illumination means alternately, so that alternate flashes are generated, with each flash being operable to fix the thermoplastic particles onto different sections of a support sheet, said circuit means including a plurality of trigger circuits, one for each illumination means, and each operable to initiate conduction of its illumination means, a single pulse generator operable to control each of said trigger circuits, and a controller for enabling said pulse generator and a selected trigger circuit to thereby initiate alternate operation of said trigger circuits and conduction of a selected one of said flash illumination means.

* * * * *